US005902061A

United States Patent [19]

Ackermann et al.

[11] Patent Number: 5,902,061

[45] Date of Patent: May 11, 1999

[54] LIPSTICK CONTAINER AND METHOD OF MAKING SAME

[75] Inventors: Walter T. Ackermann, Watertown; Thomas F. Holloway, Southbury, both of Conn.

[73] Assignee: Risdon Corporation, Naugatuck, Conn.

[21] Appl. No.: 09/028,106

[22] Filed: Feb. 23, 1998

[51] Int. Cl.[6] ..... B43K 21/08

[52] U.S. Cl. ..... 401/75; 401/68

[58] Field of Search ..... 401/75, 68, 76, 401/77, 78, 49, 55

[56] References Cited

U.S. PATENT DOCUMENTS

| | | | |
|---|---|---|---|
| 2,419,526 | 4/1947 | Anderson | 401/75 |
| 2,610,734 | 9/1952 | Noyack | 401/76 |
| 2,823,796 | 2/1958 | Schwartz et al. | 401/75 |
| 5,599,124 | 2/1997 | Ackermann et al. | 401/78 |
| 5,813,421 | 9/1998 | Wang | 401/68 |

*Primary Examiner*—David J. Walczak
*Attorney, Agent, or Firm*—Dallett Hoopes

[57] ABSTRACT

A centerpost carrying a pomade cup on its upper end is threaded into a cup-shaped base. The pomade cup slides in a tubular nosepiece which rides in the base and which is keyed for rotation with the centerpost. The assembly method includes inverting the nosepiece and cup and filling it, reinverting and connecting the post and cup and the base and nosepiece. The threaded centerpost may "tap" threads into longitudinal ribs in the base during assembly.

11 Claims, 4 Drawing Sheets

LIPSTICK CONTAINER AND METHOD OF MAKING SAME

FIELD OF THE INVENTION

This invention relates to lipstick containers of the propel-repel type. More specifically, this invention relates to slender lipstick containers of the type generally designated "slim-line" lipsticks in the trade. The invention also relates to a method of making and filling such containers.

BACKGROUND OF THE INVENTION

For fashion purposes, there has been a desire to have lipstick containers of elegant, slender, elongated lines. To achieve this shape, the container structure has been greatly modified so that the driving mechanism (cam, innerbody, etc.) normally surrounding the pomade cup and adding to the diameter of the container is located entirely under the pomade cup. Examples of such rearrangement are disclosed in the U.S. Pat. Nos. 4,770,556 issued Sep. 13, 1988 to Ackermann et al and 5,172,993 issued Dec. 22, 1992 also to Ackermann et al. These "slimline" containers have often comprised a floating sleeve threaded and engaged by threads or lugs in both the base and on the cup stem. Such containers have been filled from the top, usually by loading into the cup a pre-formed pomade "bullet".

Over the past few years the nature of the pomade used in lipstick has changed. Rather than being essentially wax cylinders, lipstick pomades are now composed largely of volatile silicone compositions. The change in composition has been caused by the fashion-driven demand for a high-lustre lipstick analogous to a paint which, when applied, gives a "wet look". The downside of such pomade compositions is that when they are exposed to the air, they will rapidly dry out so that they become, in effect, a hard, solid, non-fluid substance which cannot be applied to the skin. In addition, as such pomades dry out, they shrink in size and, being slippery, can actually fall out of the elevator cup of their containers.

The present invention discloses a simplified "slimline" structure which has two important attributes: it can be rapidly filled by being molded directly in the container, so that the pomade is more securely anchored in the elevator cup. Secondly, the container can be conveniently sealed to prevent air from freely contacting the silicone-containing pomade.

SUMMARY OF THE INVENTION

The invention is a container for lipsticks comprising a cup-shaped base over which an inverted cup-shaped cover can be readily installed in a sealing fit. The base is internally threaded and a centerpost inside the wall is provided with mating threads on its lower end. A nosepiece which is keyed at its lower end for rotation with the centerpost is provided and telescopes with the top of the base. The nosepiece contains an elevator cup for holding the pomade. The lower end of the nosepiece and the upper end of the base are formed with respective halves of a first coupling, and the lower end of the cup and the upper end of the centerpost are formed with respective halves of a second coupling.

With couplings engaged, the nosepiece is free to rotate relative to the base and the nosepiece is keyed for rotation with the threaded centerpost. As a result, the turning of the nosepiece relative to the base raises or lowers the pomade.

The invention also comprises the method of assembly of the aforementioned structure. In the method the cup is disposed inside the nosepiece at a predetermined position. The nosepiece is then inverted and filled from the "lower end", that is, the end normally the lower end. Once filled and set, the nosepiece is re-inverted and connected to the base by the first coupling, and the cup is connected to the upper end of the centerpost by the second coupling.

As part of the method, the lower end of the centerpost is enlarged and formed with external threads, and the inside of the base is formed with longitudinal ribs. The internal threads described above on the base are formed as the centerpost is "screwed into" the base, "tapping" threads into the ribs. For this purpose the centerpost may be made of a relatively "hard" plastic such as "Delrin", an acetal, while the base is of a "softer" plastic.

BRIEF DESCRIPTION OF THE DRAWINGS

Further objects and features of the invention will be clear to those skilled in the art from a review of the following specification and drawings, all of which present a non-limiting foam of the invention. In the drawings:

FIG. 1 is a sectional view taken along the axis of a lipstick, unfilled, embodying the invention, with the center-post in profile;

DESCRIPTION OF THE PREFERRED EMBODIMENT

Figure 1A:
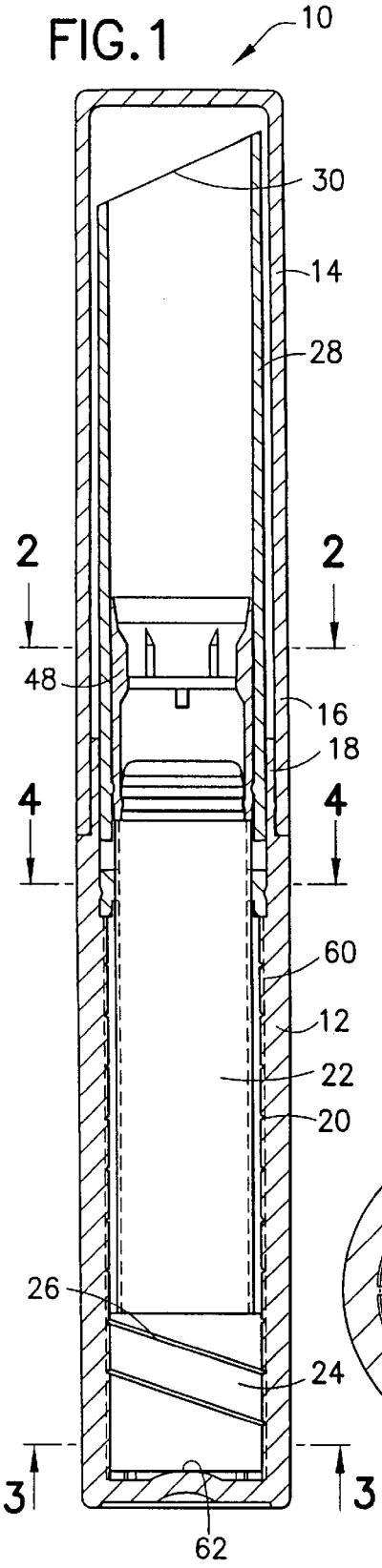
FIG. 1A is a greatly enlarged portion of FIG. 1.
Figure 1A:
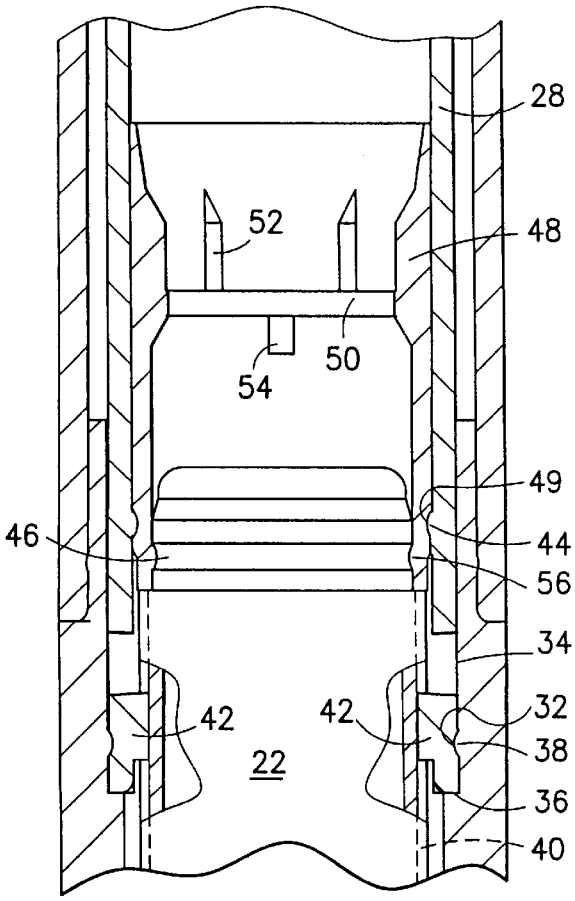
Figure 2:
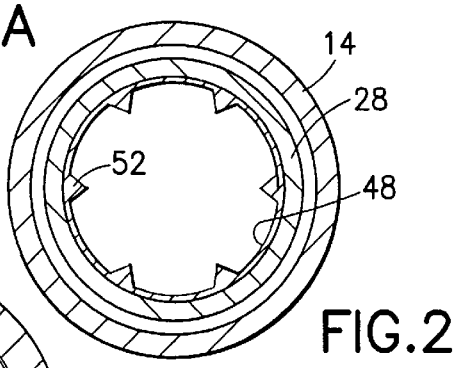
FIG. 2 is a sectional view taken on the line 2—2 of FIG. 1.
Figure 3:
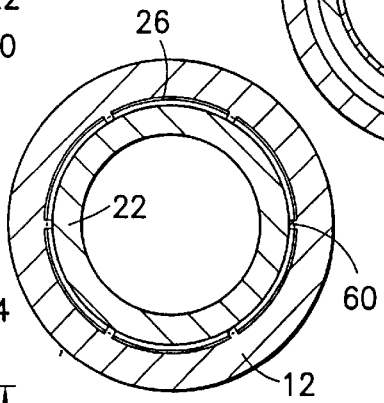
FIG. 3 is a sectional view taken on the line 3—3 of FIG. 1.

An assembled lipstick container embodying the invention is generally designated 10 in FIG. 1. It comprises a base 12 and a telescoping cover 14. At its lower portion 16 the cover 14 telescopes over a reduced upper portion 18 of the base. By configuration of the parts, these portions 16, 18 comprise a seal precluding entry of air into the container for reasons aforesaid. Such sealing may be as discussed in the co-pending application entitled "Sealed Lipstick Container", Ser. No. 08/900,730, filed Jul. 25, 1997 by Walter T. Ackermann.

The base 12 is formed with internal threads 20 to be more specifically described.

A centerpost 22 is disposed inside the base 12 and is formed with an enlarged lower end 24 which is provided with unitary external threads 26 engaged with threads 20.

A tubular nosepiece 28 is provided. Its upper end may have a beveled mouth 30. Its lower end is formed with a peripheral groove 32 (FIG. 1A) forming half of a first coupling.

Adjacent its upper end, the base 12 is formed with a widened mouth 34 providing an annular stop shoulder 36 where the mouth meets the inside diameter of the base below the upper end.

At a distance above the shoulder 36 the base is formed with an inward peripheral line of bumps 38 comprising the other half of the first coupling.

In assembly, the nosepiece 28 is telescoped down into the mouth 34 until it bottoms against the stop 36. At this point, the halves 32, 38 of the first coupling are inter-engaged so that the base and the nosepiece are rotatably held together.

Figure 4:
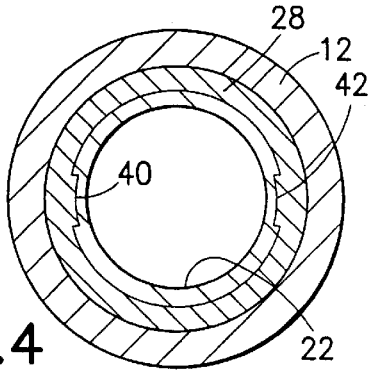
FIG. 4 is a sectional view taken on the line 4—4 of FIG. 1.
Figure 5:
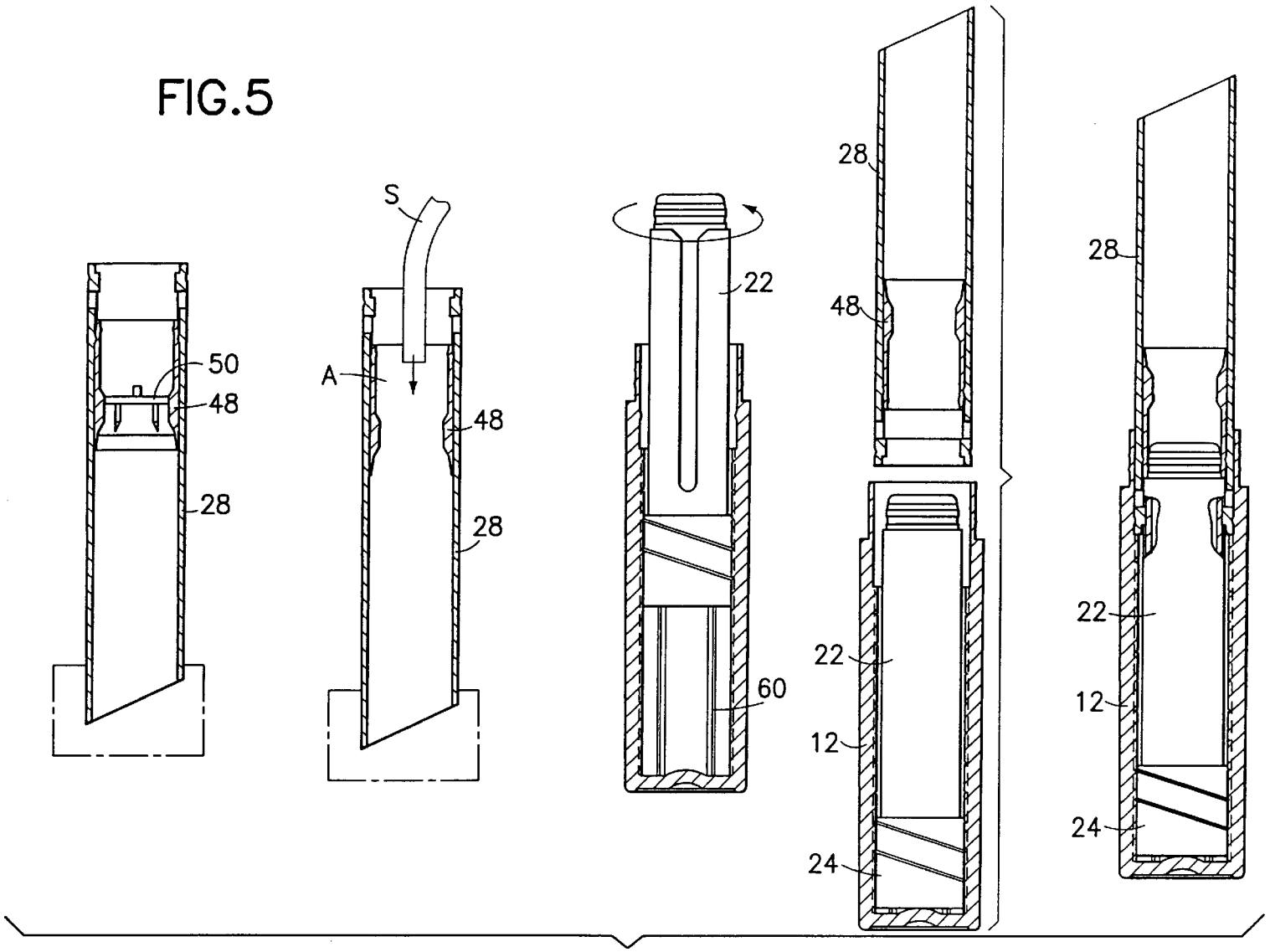
FIG. 5 is a composite preview of FIGS. 6–10, shown successively from left to right, reduced, to represent the steps of the method of the invention.

Returning to the description of the centerpost 22, it is tubular (FIG. 4) and formed on its outside with a pair of longitudinal diametrically opposite grooves 40 extending from the upper end down to the enlarged lower end 24. The lower end of the nosepiece 28 is formed with a pair of inward lugs 42. In assembly, as shown, the lugs 42 ride in the grooves 40 so that the nosepiece 28 and the centerpost 22 are keyed for rotation together. The nosepiece is also formed with an inward retaining rib 44 (FIG. 1A).

The upper end of the center post 22 is formed with a peripheral groove 46 which comprises one half of the second coupling. An elevator cup 48 is generally tubular and slidably fits inside the nosepiece 28. It has an external retaining groove 49. The inside of the cup is formed with an inward rib 50 from which extend upward short longitudinal ribs 52 at spaced intervals as well as downward support webs 54. The lower end of the elevator cup 48 is formed with an inward peripheral rib 56 to comprise the other half of a second coupling. In assembly, the upper end of the post telescopes into the lower end of the cup 48 so that the rib 56 snaps into the groove 46 of the post. By the second coupling, the cup 48 is fixed to the upper end of the centerpost 22.

The structure thus far described operates in a predictable way: with the cover 14 removed, the turning of the nosepiece 28 relative to the base 12 will, because of the connection between the lugs 42 and the grooves 40, cause relative rotation of the base 12 and the centerpost 22. Because of the threads 20, 26 on the base 12 and centerpost 22, this relative rotation will cause the centerpost to rise or move down, taking with it the cup 48 along with the pomade (not shown) therein.

Figure 6:
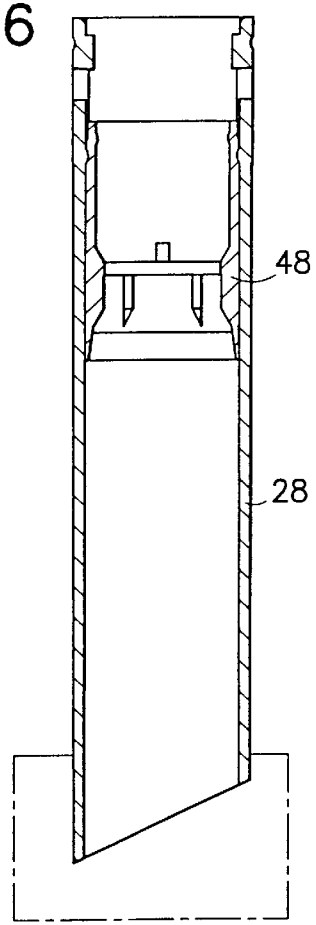
FIG. 6 is a sectional view of the nosepiece and pomade cup inverted.

Turning now to the method of assembly, as shown in FIG. 6, the nosepiece 28 and cup 48 are pre-assembled with the cup in the nosepiece in a filling position whereat the retaining rib 44 is received into the retaining groove 49 (FIG. 1A). This retaining is temporary: only for the purpose of filling and assembly. The pre-assembly then is inverted. The "lower end" of the nosepiece as shown in FIG. 6 is closed off as indicated by the phantom lines. The pre-assembly is then filled from a source of fluid pomade symbolized by a spout S, up beyond the rib 50, leaving some space A thereabove to accommodate the end of the centerpost 22.

Figure 8:
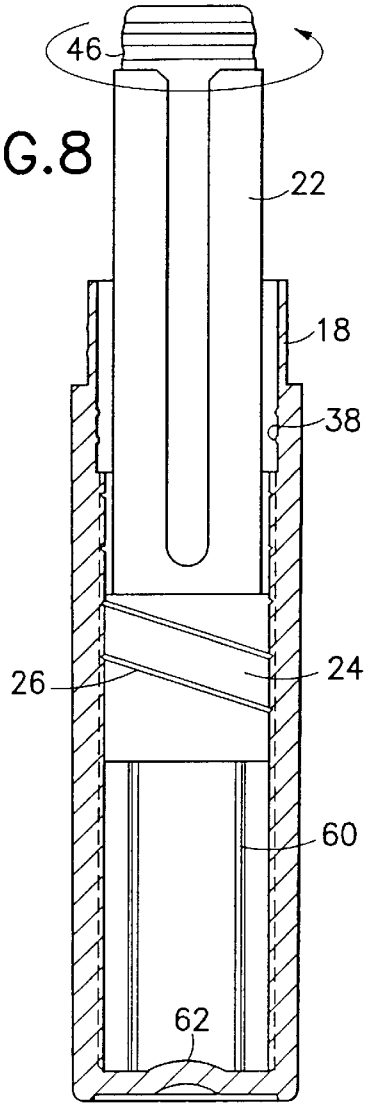
FIG. 8 is a sectional view of the base and the centerpost being rotated to create threads in the base.
Figure 7:
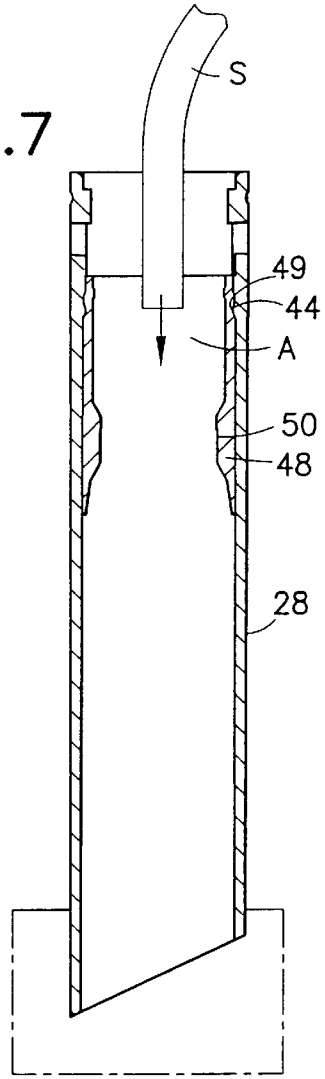
FIG. 7 is a sectional view of the nosepiece and pomade cup inverted undergoing filling.

As referred to above, the formation of the threads 20 in the base 12 will now be detailed. The interior of the base 12, is formed with a plurality of longitudinal ribs 60 (FIG. 8). The ribs 60 as shown are tapered, narrowing toward the axis of the base. In assembly, the centerpost 22 is turned in the direction of the threads 26 as the centerpost 22 progresses downward into the base 12. In this manner, the threads 26 impinge on and "tap" threads into the ribs 60 which thus become the so-called internal threads 22 of the base. By the time the centerpost reaches the lower end of the base 12 and dimple 62, the internal threads are completed and thereafter form the mating threads in which the centerpost operates. For the purpose described, the centerpost must be of a relatively hard plastic such as "Delrin" or "Celcon" acetals. The base may be of a high density polyethylene.

Figure 9:
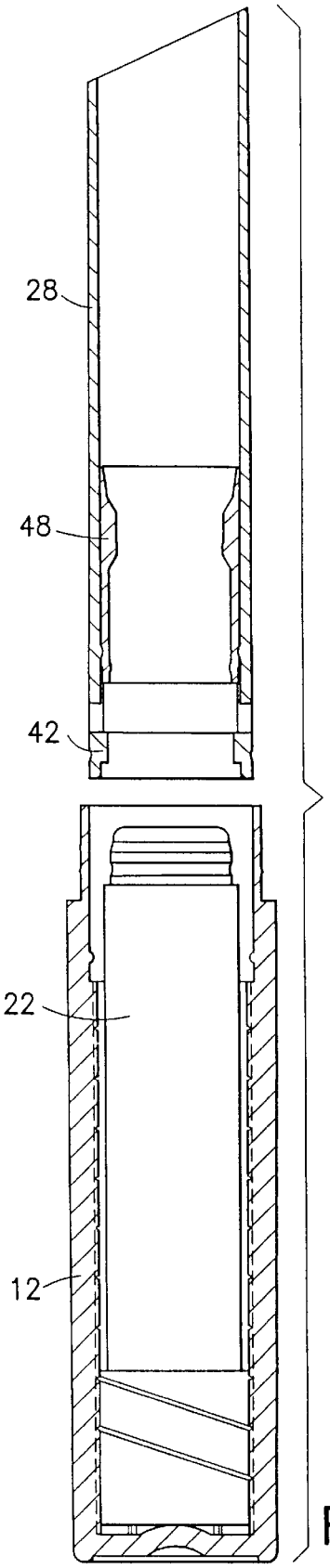
FIG. 9 is an exploded sectional view of the nosepiece and pomade cup disposed above the base and centerpost—the centerpost being in profile—prior to assembly.

Proceeding with the description of the method, the pre-assembled nosepiece 28 and elevator cup 48 are re-inverted and aligned with the pre-assembled base 12 and centerpost 22 (FIG. 9). The lower end of the nosepiece 48 is inserted into the mouth 34 of the base 12 until it bottoms on the stop 36 (FIG. 1A). At this depth the rib 38 of the base snaps into the groove 32 adjacent the lower end of the nosepiece comprising the first coupling and rotatably connecting the nosepiece 28 and the base 22. In the process the inward lugs 42 of the nosepiece 28 enter and ride in the grooves 40 in the centerpost.

Figure 10:
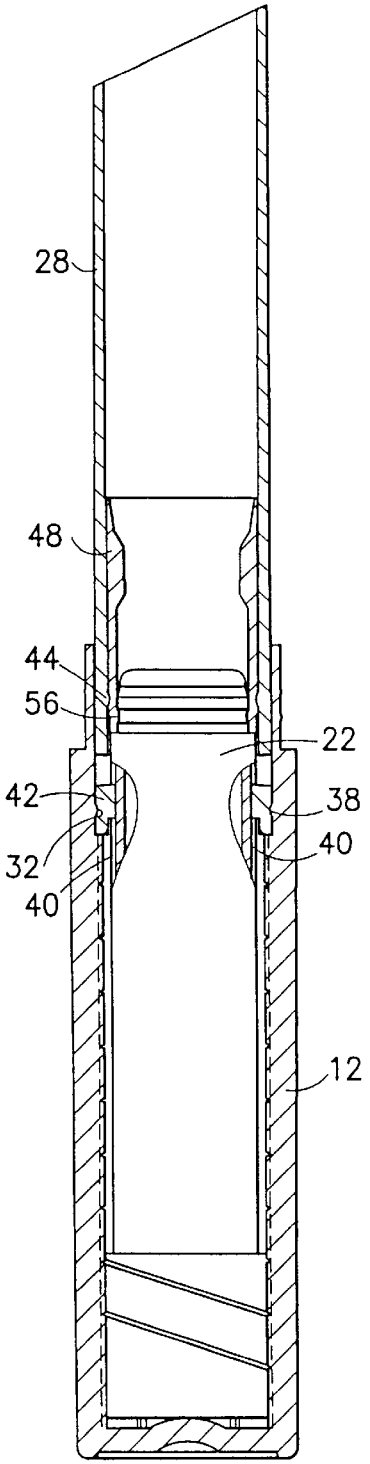
FIG. 10 is a sectional view of the assembled lipstick, filled, showing the centerpost partly in section.

With the cup 48 at a temporary fixed level in the nosepiece as a result of the nesting of retaining rib 44 and groove 49, the upper end of the centerpost simultaneously enters the lower end of the cup 48. At the same stage in the assembly as the first coupling engages, the second coupling comprising rib 56 and groove 46 also engages to attach the centerpost 22 and the cup 48 (FIG. 10).

With the assembly thus complete, the initial forcible raising of the cup 48 by the turning of the base as described, causes the retaining groove 49 to pop upward free from the rib 44. Thereafter, on the complete retraction of the cup, the rib 44 and groove 49 may interfit, but such interfitting is of no consequence.

When the pomade, silicone-containing or otherwise, is fully retracted, the cover 14 may be installed over the nosepiece, and the container is sealed as the portions 16 and 18 engage. Aside from the sealing feature, the lipstick container hereabove disclosed includes a fluid filling from the bottom so that the lipstick is molded into the cup 48 and will not be easily displaced even should there be some shrinkage of pomade. Over and above these benefits, the present invention provides a container having the elegant, slender shape that the current fashions seek.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A method of assembly of a lipstick container comprising a cup-shaped base having a first half of a first coupling about its mouth and internal threads therebelow, and a centerpost having a longitudinal groove, a threaded lower end engaging the internal threads of the base, and a first half of a second coupling at its upper end, a tubular nosepiece having a second half of the first coupling about its upper end, and a pomade cup riding in the nosepiece and having a second half of the second coupling in the lower end of the cup, the nosepiece having an inward lug adjacent its lower end, the method comprising the steps of:

a. inverting the tubular nosepiece and cup and filling the nosepiece and cup through the lower end of the nosepiece with pomade, b. reinverting the cup and nosepiece and coupling with the first coupling the lower end of the nosepiece with the mouth of the base and coupling with the second coupling the cup and the upper end of the centerpost, whereby the lug slides in the longitudinal groove in the centerpost and keys the post and nosepiece for rotation together.

2. A method as claimed in claim 1 wherein the base is formed with inward longitudinal ribs and the centerpost is formed with outward threads and the method of assembly includes the additional step of rotating the centerpost inside the base to create the internal threads in the inward longitudinal ribs.

3. A method as claimed in claim 1 including the step prior to filling the nosepiece of fixing the position of the cup in the nosepiece and maintaining the position during filling.

4. A lipstick container comprising:

a. a cup-shaped base having internal threads and a first half of a first coupling at the upper end thereof, b. a centerpost having a longitudinal groove and an enlarged threaded lower end having threads engaging the internal threads of the base, the upper end of the post having a first half of a second coupling, c. a tubular nosepiece having a second half of the first coupling at the lower end thereof, the halves of the first coupling being engaged to rotatably attach the nosepiece and the base, the nosepiece having an inward lug adjacent its lower end, the lug fitting into the groove in the centerpost, d. a pomade cup reciprocable in the nosepiece and having a second half of the second coupling in its lower end, the first and second halves of the second coupling being engaged.

5. A lipstick container as claimed in claim 4 wherein the internal threads of the base are transverse grooves in longitudinal ribs on the inside of the base.

6. A lipstick container as claimed in claim 4 wherein the first and second halves of the first coupling are a rib and a groove.

7. A lipstick container as claimed in claim 4 wherein the first and second halves of the second coupling are a rib and a groove.

8. A lipstick container as claimed in claim 4 wherein the nosepiece has a circumferential retaining rib on its inside surface and the pomade cup has a retaining groove about its outside surface.

9. A lipstick container comprising:

a. a cup-shaped base having internal threads, b. a tubular nosepiece rotatably connected at its lower end to the upper end of the base, c. a pomade cup slidably disposed in the tubular nosepiece, d. a centerpost having on its lower end external threads engaging the internal threads in the base, the upper end of the centerpost being connected to the pomade cup, and e. means connecting the centerpost and the tubular nosepiece for rotation together.

10. A lipstick container as claimed in claim 9 wherein the internal threads of the base are transverse grooves in longitudinal ribs on the inside of the base.

11. A pre-assembly for the making of a lipstick container comprising a tubular nosepiece and a pomade cup normally slidable in the nosepiece, the nosepiece having a circumferential retaining rib on its inside surface, and the pomade cup having a circumferential groove on its outside surface, the rib and groove being interfitted to retain the pomade cup in the nosepiece at a fixed location during a pomade-filling operation.

* * * * *